US010760368B2

(12) United States Patent
Pich

(10) Patent No.: US 10,760,368 B2
(45) Date of Patent: Sep. 1, 2020

(54) APPARATUS FOR CONTROLLING INJECTION PRESSURE FOR THE ASSISTED RECOVERY OF OIL USING POLYMER

(71) Applicant: S.P.C.M. SA, Andrezieux Boutheon (FR)

(72) Inventor: René Pich, Andrezieux Boutheon (FR)

(73) Assignee: S.P.C.M. SA (FR)

( * ) Notice: Subject to any disclaimer, the term of this patent is extended or adjusted under 35 U.S.C. 154(b) by 0 days.

(21) Appl. No.: 16/337,682

(22) PCT Filed: Sep. 28, 2017

(86) PCT No.: PCT/FR2017/052642

§ 371 (c)(1),
(2) Date: Mar. 28, 2019

(87) PCT Pub. No.: WO2018/065699

PCT Pub. Date: Apr. 12, 2018

(65) Prior Publication Data

US 2019/0338616 A1 Nov. 7, 2019

(30) Foreign Application Priority Data

Oct. 3, 2016 (FR) ..... 16 59515

(51) Int. Cl.
*E21B 33/068* (2006.01)
*E21B 34/00* (2006.01)
*E21B 43/16* (2006.01)

(52) U.S. Cl.
CPC ..... *E21B 33/068* (2013.01); *E21B 34/00* (2013.01); *E21B 43/16* (2013.01)

(58) Field of Classification Search
CPC ..... E21B 33/068; E21B 34/00; E21B 43/16; E21B 43/20
See application file for complete search history.

(56) References Cited

U.S. PATENT DOCUMENTS 3,608,631 A * 9/1971 Sizer ..... E21B 23/08 166/70
4,510,993 A * 4/1985 Luetzelschwab ..... C09K 8/588 137/504

(Continued)

FOREIGN PATENT DOCUMENTS

| | | |
|---|---|---|
| FR | 2962153 | 1/2012 |
| WO | WO2015092334 | 6/2015 |
| WO | WO2016051051 | 4/2016 |

*Primary Examiner* — James G Sayre
(74) *Attorney, Agent, or Firm* — Forge IP, PLLC

(57) ABSTRACT

An apparatus for controlling the injection pressure of an aqueous polymeric solution in an oil well is formed by: at least one pressure modulation valve, allowing, per valve, a maximum pressure loss of 5 bars practically without any mechanical deterioration, the one or more valves being connected in line with; a tube containing vortex modules, each creating a maximum pressure loss of 5 bars, practically without any mechanical deterioration, a vortex module being a section of tube, which is closed at one of its ends by a cap perforated with a hole, and which can be inserted into the detachable tube. The purpose of the apparatus is the ability to reduce the pressure to 100 bars with total mechanical deterioration of less than 10%. A method for using the apparatus is also contemplated.

11 Claims, 1 Drawing Sheet

(56) References Cited

U.S. PATENT DOCUMENTS

| | | | | |
|---|---|---|---|---|
| 4,782,847 | A * | 11/1988 | Luetzelschwab | E21B 43/20 137/13 |
| 9,260,937 | B2 | 2/2016 | Chauveteau et al. | |
| 2012/0292029 | A1 | 11/2012 | Soucy | |
| 2016/0168954 | A1 | 6/2016 | Pich et al. | |

* cited by examiner

APPARATUS FOR CONTROLLING INJECTION PRESSURE FOR THE ASSISTED RECOVERY OF OIL USING POLYMER

BACKGROUND OF THE INVENTION

During the establishment of an oilfield operation, several phases of production can be distinguished:

First, the production of oil due to the internal pressure of the field, which is usually quickly reduced;

Then, pressure is maintained by injecting water (water flooding) until the producing wells reach an oil/water concentration of 2 to 5%. At that time, the cost of water injection makes the cost of the oil noncompetitive;

Next, enhanced oil recovery by various methods.

One of the methods consists in injecting a viscous solution of polymers, particularly polyacrylamide, in order to mobilize a larger volume of the field.

This method was industrialized during the first oil crisis in 1973.

However, the injected polyacrylamides are sensitive to the mechanical and chemical deterioration of the molecular weights, which requires precise handling in order to maintain their effectiveness.

In general, polymers are in the form of powder that is dissolved in water at a rather high concentration, in order to reduce the size of the maturation vessels, i.e. dissolution vessels. Indeed, the dissolution time of these powders is on the order of one hour. The concentration of these solutions is from 10 to 20 grams/liter with high viscosities (1000 to 10,000 cps).

To be used, this stock solution must be diluted to 1 to 3 grams/liter in order to be injected. Various methods are used to prevent mechanical deterioration by a sharp pressure drop, in order to adapt the injection pressure to the pressure of the specific well.

The first consists in installing one metering pump per well, and sending the stock solution to the head of each well in order to dilute it with the injection water.

The second method consists in diluting the stock solution on the dissolution platform, and of sending this diluted solution into each well by separate pipelines.

The third method consists in totally diluting the stock solution with all the injection water, and of using water injection lines. This method requires the lowest investments.

In this case, the water pump will be set higher than the pressure of the well that has the highest pressure, and the pressure on the other wells will have to be reduced; this normally results in a deterioration that increases as the pressure differential increases.

To prevent this deterioration, specific pressure reducers are used that should not deteriorate the polymer.

Several methods are possible:

Pressure reduction by a long, calibrated tube that allows pressure reductions of up to 60 to 100 bars, with less than 5 or 10% deterioration depending on speed and the length of the tube (document US 2012/0292029).

The optimal speed is on the order of 10 meters/second. Normally, a pressure drop of 1 bar per 10 meters of tube can be created, or 500 meters for 50 bars. According to this patent, the pressure drop can be modulated by cutting the tube into various lengths that can be fed or bypassed.

Pressure reduction by vortex effect with a tube equipped with caps creating a vortex effect.

U.S. Pat. No. 4,782,847 utilizes fixed caps producing a pressure loss without deterioration up to pressure differences of 5 bars, and a modulation needle valve that also works by vortex effect and which allows a variation from 0 to 5 bars depending on the opening, with a minimum of deterioration.

Pressure reduction by vortex effect with a plurality of needle (or other) valves that can each create a pressure drop of about 5 bars with minor deterioration (document US 2016/0168954).

With about 10 valves, a pressure drop of 50 bars can be created. The valve heads can be equipped with hydraulic motors in series, enabling the same opening on all valves with a single adjustment.

These systems are cumbersome for the first one, not very scalable for the second one, and rather expensive for the third one.

The demand of oil companies is for maximum pressure drops of about 50 bars, with little deterioration, with a modulation per well of about 10 bars, and a possibility of feeding wells whose pressure varies over time, with a simple, inexpensive apparatus.

The equipment must therefore be very flexible and easy to handle.

SUMMARY OF THE INVENTION

The proposed solution is as follows:

The modulation on each pressure reducer is accomplished by at least one valve, preferably two valves, each creating a pressure loss of up to 5 bars without significant deterioration of the polymer;

A linear tube, in which a variable number of vortex modules are inserted, composed of a section of internal tube with a restriction creating the vortex effect corresponding to 5 bars (FIGS. 1 and 2).

An object of the invention is an apparatus for controlling the injection pressure of an aqueous polymeric solution in an oil well, said apparatus being formed by:

At least one pressure modulation valve allowing a maximum pressure loss of 5 bars per valve with practically no mechanical deterioration, said one or more valves being connected in line with;

A tube containing vortex modules, each creating a maximum pressure loss of 5 bars, with practically no mechanical deterioration, a vortex module being a section of tube, which is closed at one end thereof by a cap perforated with a hole, and which can be inserted into the tube;

the purpose of the apparatus being that of being able to reduce the pressure to 100 bars with total mechanical deterioration of less than 10%.

"Mechanical deterioration" is understood as meaning the deterioration of the polymer in the solution injected into the well, measured by the decrease in viscosity of the solution after passing through the pressure regulation apparatus.

Preferably, the hole in the cap has a diameter of between 10 and 25 mm. The valves are needle type, although other types of valves can function as well. The hole is preferably in the central position.

Each vortex module can be positioned so that the hole is downstream or upstream from the flow. Preferably, the vortex modules are all positioned in the same direction with the hole downstream from the flow of the aqueous polymeric solution.

The great advantage of these modules is their extreme modularity. The largest injections in oil wells normally require a two-inch (about 50 mm) tube with respect to the pressure reducers.

Thus, a module with inside diameter of 50 mm and two 2-inch needle valves can be used. Said diameter of 50 mm is given by the interior of the vortex module, which will have the necessary restriction for a passage enabling a pressure loss of 5 bars. Said restriction can be from 10 to 25 mm, while maintaining the outside diameter of the vortex module. Each module will preferably have a length of between 10 and 20 cm.

The person skilled in the art can develop these principles in accordance with the need or use. For example, these modules will be able to be composed of a perforated washer coupled with sections of 10 cm tube.

Preferably, the tube contains between 4 and 20 vortex modules. This makes it possible to obtain pressure losses ranging from 20 bars (4 modules) up to 100 bars (20 modules).

The vortex modules are capable of being inserted into the tube. Preferably, the outside diameter of the vortex modules is slightly smaller than the inside diameter of the detachable tube. Preferably, it is 1 mm smaller.

The pressure modulation valve(s) can be positioned upstream or downstream from the tube containing the vortex modules. The inside diameter of the tube is between 1.27 cm (½ inch) and 10.16 cm (4 inches), preferably between 1.27 cm (½ inch) and 7.62 cm (3 inches).

In the event of a very large flow rate on a well, it will also be possible, very quickly, to change all of the modules with smaller or larger holes to adapt the pressure loss to the intended flow rate.

Furthermore, this equipment will be able to be used in undersea injection, in which the two modulation valves are controlled from the surface by a hydraulic motor, and the tube itself will be attached by quick-connects, enabling rather easy detachment, changing of the number of modules, and reattachment.

In the same way, one or more valves can be installed to modulate the pressure and restrict or expand the control range.

An object of the invention is also a method for reducing the injection pressure of an aqueous polymeric solution depending on the pressure of the well, implementing the device according to the invention in an enhanced oil recovery method. The pressure loss created in a valve or in a vortex module is at most 5 bars, preferably between 1 and 5 bars.

The invention and resulting benefits will become clear from the following example, supported by the attached figures.

DETAILED DESCRIPTION OF THE INVENTION

Figure 1:
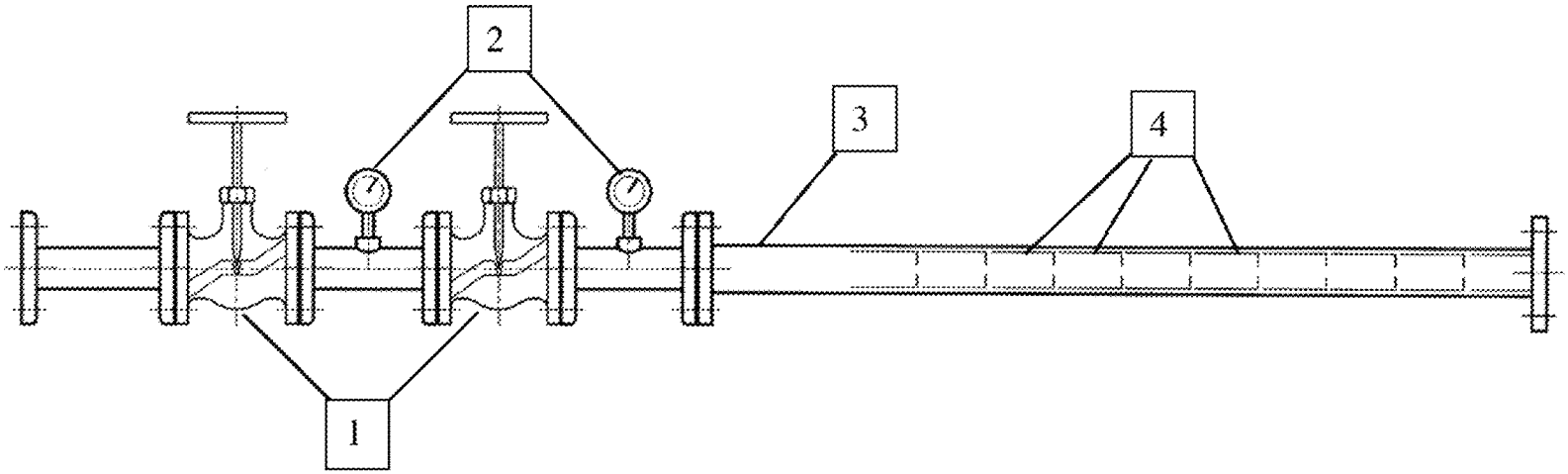
FIG. 1 represents a schematic view of the pressure regulation apparatus that can be connected in line with the main pipeline. The apparatus successively comprises two valves (1) enabling a maximum pressure reduction of 5 bars each, two pressure gauges (2) for monitoring pressure, and a detachable tube (3) containing 10 vortex modules (4), each allowing a maximum pressure reduction of 5 bars. In total, this apparatus is capable of regulating the pressure by a maximum of 60 bars.
Figure 2:
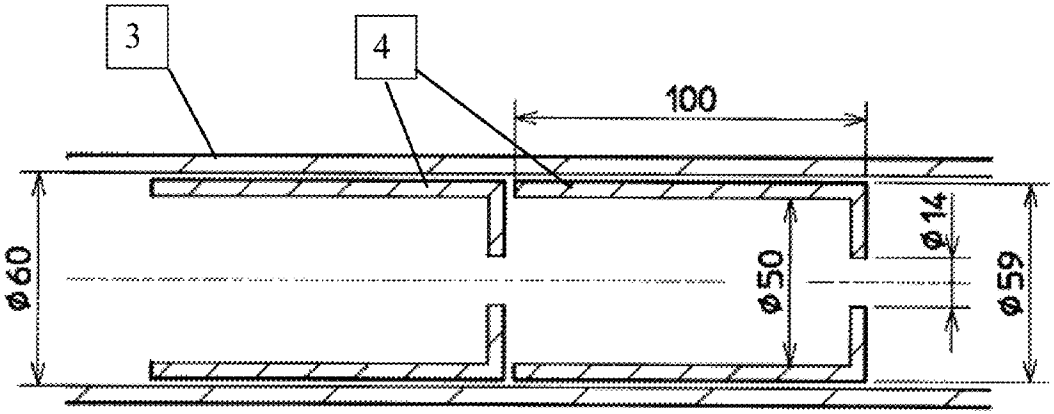
FIG. 2 represents a schematic view of one part of the detachable module (3) with inside diameter of 60 mm containing two vortex modules (4) with a length of 100 mm, outside diameter of 59 mm, inside diameter of 50 mm, each having a central orifice 14 mm in diameter.

Using the same wells as in example 1 of patent US2016/0168954 and the same polymer, the following results were obtained.

Example

Four wells are fed with a water pump at 160 bars, in which the polymer is mixed at a dose of 500 ppm by pumping, with a triplex pump and injection after the water pump.

The flow rate per well is fixed at 19 $m^3$/hour, measured with an electromagnetic flowmeter.

A pressure reducer is constructed comprising:

Two 2-inch needle valves with pressure gauges enabling adjustment between 1 and 5 bars of pressure loss;

A tube with inside diameter of 60 mm able to receive modules with outside diameter of 59 mm and inside diameter of 50 mm. The caps are perforated with a 14 mm passage to create a vortex pressure loss of 5 bars for 19 $m^3$/hour.

For the 130 bars well, 5 modules are placed in the tube, and the pressure can be modulated with the 2 valves from 125 to 135 bars.

For the 125 bars well, 6 modules are placed in the tube, and we can modulate from 120 to 130 bars.

For the 120 bars well, 7 modules are placed in the tube, and we can modulate from 115 to 125 bars.

For the 110 bars well, 9 modules are placed in the tube, enabling modulation from 105 to 115 bars.

As in the preceding tests, the deterioration noted is less than 5% even with a pressure difference of 50 bars.

In the event a well would experience increased pressure over time, as is often the case, the tube would be dismantled and a module removed, which is a simple operation.

This simple, compact and low-cost system meets the current demands of oil producers.

The invention claimed is:

1. An apparatus for controlling an injection pressure of an aqueous polymeric solution in an oil well, said apparatus comprising:

at least one pressure modulation valve allowing a maximum pressure loss of 5 bars per valve, said one or more valves being connected in line with;

a single tube of continuous inside diameter containing a plurality of vortex modules, each vortex module creating a maximum pressure loss of 5 bars, each vortex module being a section of tube, which is closed at one end thereof by an end wall perforated with a hole, and each vortex module being insertable into the single tube of continuous inside diameter containing the plurality of vortex modules;

whereby the apparatus is able to reduce the injection pressure to 100 bars with total mechanical deterioration of the aqueous polymeric solution of less than 10%.

2. The apparatus according to claim 1, wherein the hole in the end wall has a diameter of between 10 and 25 mm depending on recommended injection flowrates.

3. The device according to claim 1, wherein the valves are needle valves.

4. The device according to claim 1, wherein a length of each vortex module is between 10 and 20 cm.

5. The apparatus according to claim 1, wherein the single tube of continuous inside diameter contains between 4 and 12 vortex modules.

6. The apparatus according to claim 1, comprising at least two pressure modulation valves.

7. The apparatus according to claim 1, wherein an outside diameter of each of the vortex modules is 1 mm smaller than the inside diameters of the single tube.

8. A method for reducing an injection pressure of an aqueous polymeric solution depending on a pressure of a well, using the device according to claim 1, in an enhanced oil recovery method.

9. The method according to claim 8, wherein a pressure loss created in a valve or in a vortex module is at most 5 bars.

10. The method according to claim 8, wherein said method is an offshore method.

11. The method according to claim 8, wherein a pressure loss created in a valve or in a vortex module is between 1 and 5 bars.

* * * * *